United States Patent [19]

Ando et al.

[11] Patent Number: 4,612,771

[45] Date of Patent: Sep. 23, 1986

[54] IDLING CONTROL DEVICE FOR INTERNAL COMBUSTION ENGINE WITH TURBOCHARGER

[75] Inventors: Hirohumi Ando, Kariya; Takashi Kondo, Toyota, both of Japan

[73] Assignee: Nippondenso Co., Ltd., Kariya, Japan

[21] Appl. No.: 661,476

[22] Filed: Oct. 16, 1984

[30] Foreign Application Priority Data

Oct. 24, 1983 [JP] Japan ..... 58-199830

[51] Int. Cl.[4] ..... F02B 37/00

[52] U.S. Cl. ..... 60/611

[58] Field of Search ..... 60/600, 601, 611; 123/559, 564

[56] References Cited

U.S. PATENT DOCUMENTS 4,449,371 5/1984 Sone et al. ..... 60/611
4,551,977 11/1985 Matsumura ..... 60/611

FOREIGN PATENT DOCUMENTS 52651 3/1982 Japan ..... 60/611
58-158139 10/1983 Japan .
2129056 5/1984 United Kingdom ..... 60/611

*Primary Examiner*—Michael Koczo
*Attorney, Agent, or Firm*—Cushman, Darby & Cushman

[57] ABSTRACT

An idling control device for an internal combustion engine provided with a turbocharging system having an air flow control valve mounted in a bypass passage of the intake pipe and a check valve provided downstream of said flow control valve in the same bypass passage for preventing the backflow of the turbocharged air through the air flow control valve.

2 Claims, 2 Drawing Figures

PRIOR ART

IDLING CONTROL DEVICE FOR INTERNAL COMBUSTION ENGINE WITH TURBOCHARGER

BACKGROUND OF THE INVENTION

The present invention relates to an idling control device for an internal combustion engine with a turbocharger; particularly it is useful when provided on an automobile engine.

As shown in FIG. 1, in a conventional idling control device for internal combustion engine with a turbocharger, one end of a bypass passage 20 for idling control is opened upstream of a turbocharger 3, and the other end of the passage 20 is opened to a surge tank 8 provided between the internal combustion engine 10 and the turbocharger 3. In this bypass passage 20 there is provided a flow control valve 12 which is actuated by an actuator 4 to be controlled by a computer 5. The flow control valve 12 controls the amount of air to be supplied into the engine at idling by changing the passage area of the bypass passage 20.

However, in the device of this construction, the downstream side of the flow control valve 12 (on the side of the surge tank 8) is exposed to vacuum and the upstream side thereof is exposed to the atmosphere, at idling operation. On the other hand, at the time of turbocharging, the downstream side of the valve is exposed to the turbopressure, and the upstream side thereof is exposed to the atmosphere. Therefore, the flow control valve 12 receives a rightward force in FIG. 1 because of the pressure difference at idling, and receives a leftward force in FIG. 1 at the time of turbocharging. When the flow control valve 12 receives a leftward force, the actuator 4 which actuates the control valve 12 has to complete with an excessive force. Moreover, the valve 12 provides a poor antivibration performance when turbocharging, because of the fact that the leftward force applied when in turbocharging operates to weaken the spring force of the spring 13 which is provided on the flow control valve 12 to urge it onto its valve seat. Further, when in turbocharging, the turbocharged air is applied directly to the flow control valve 12, therefore sometimes the turbocharged air leaks through a gap at the flow control valve 12 to the side of the atmosphere from the surge tank 8, thereby weakening the effect of turbocharging. When the turbocharged air leaks toward the atmosphere, the oil mist and soot in the surge tank 8 deteriorate the function of the flow control valve 12, since they tend to enter into the actuator 4.

SUMMARY OF THE INVENTION

The present invention purposes to prevent the backflow of the air turbocharged toward the atmosphere to maintain the performance of the flow control valve and, instead, to apply the turbocharged air to the engine as originally planned.

The present invention also purposes to eliminate the pressure difference at the flow control valve when in turbocharging, thereby to actuate the flow control valve by the operation of the actuator as originally scheduled, without being affected by the pressure of the turbocharging.

DETAILED DESCRIPTION OF PREFERRED EMBODIMENTS

Figure 1:
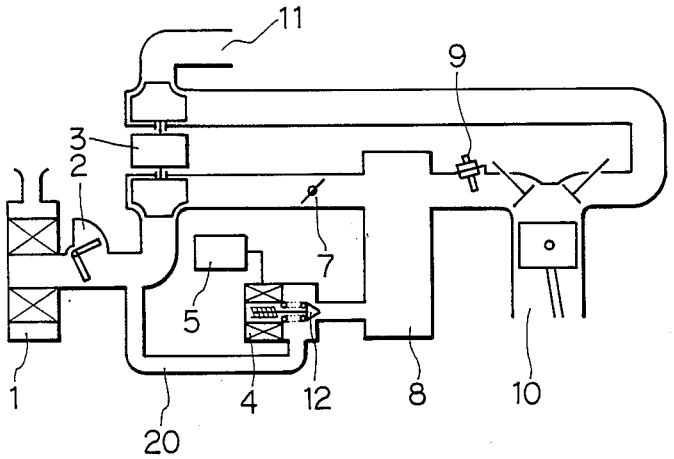
FIG. 1 is a schematic view of an internal combustion engine with a turbocharging system of a conventional type.
Figure 2:
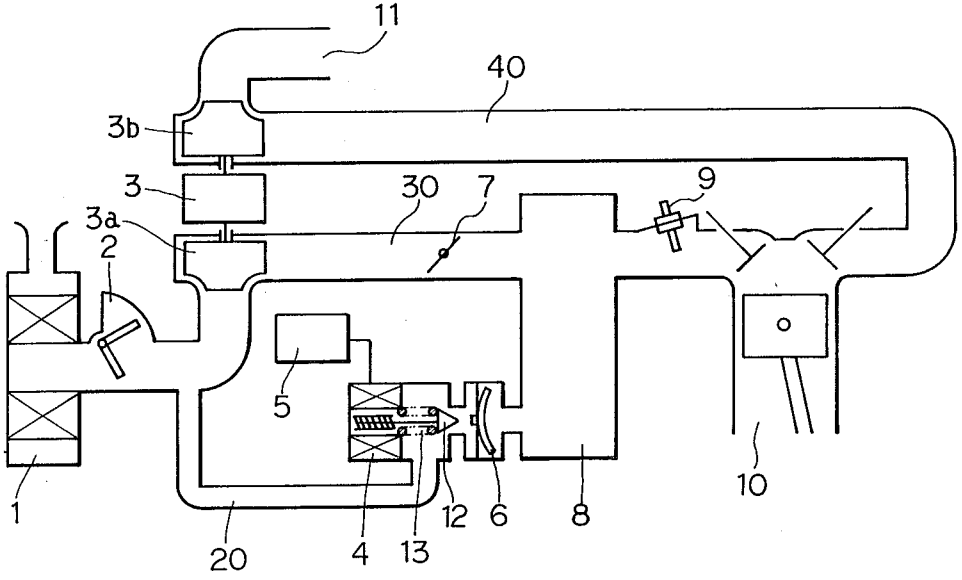
FIG. 2 shows a schematic view of an internal combustion engine provided with a turbocharging system of the present invention.

In FIG. 2 showing an embodiment of the present invention, numeral 1 designates an air cleaner which filtrates out dust in the atmosphere. Numeral 2 designates an air flow meter which detects or measures the amount of air to be supplied through the air cleaner 1, and is provided downstream of the air cleaner 1. The air cleaner 1 and the internal combustion engine 10 are connected by an intake pipe 30, in which a throttling valve 7 is provided to change the passage area of the intake pipe 30 according to the depression of an accelerator. Between the throttling valve 7 and the internal combustion engine 10 there is provided a surge tank 8 to prevent pulsation of the pressure of the intake air.

There is provided a compressor 3*a* to pressurize the air supplied from the air cleaner 1 between the throttling valve 7 and the air flow meter 2. The compressor 3*a* is put on the same axis where a turbine 3*b* is provided in an exhaust pipe 40. The exhaust pipe 40 leads exhaust gases from the internal combustion engine 10 into the atmosphere, and the exhaust gases therein cause turbine 3*b* to rotate by the pressure thereof, thus causing the compressor 3*a* to rotate to pressurize the air from the air cleaner 1. The compressor 3*a* and turbine 3*b* constitute a turbocharger 3.

Numeral 20 designates a bypass passage, one end of which is opened upstream of the compressor 3*a* and downstream of the air flow meter 2, and the other end of which is opened to the surge tank 8. In this bypass passage 20 is there provided a flow control valve 12 to vary the passage area of the bypass passage 20. The flow control valve 12 is actuated by an actuator 4 which is composed of a pulse motor. Further the actuator 4 receives a drive pulse to operate thereon from a computer 5 which receives signals of rotational speed of the engine, vehicle speed, temperature of the engine, on-off operations of air conditioners, and so on and generates the drive pulse.

Numeral 6 designates a check valve provided between the surge tank 8 and the flow control valve 12. The check valve 6 allows the air flow from the flow control valve 12 toward the surge tank 8, while it prevents the air flow from the surge tank 8 toward the flow control valve 12. Although a sheet valve is adapted to form the check valve 6 in this embodiment, a check valve composed of a ball is also usable in this system.

Numeral 9 designates an injector provided between the internal combustion engine 10 and the surge tank 8, which injects fuel into the air introduced through the intake pipe 30. The fuel thus injected and the air mixed as such are fed into the internal combustion engine 10 to be burned therein.

The operation of an embodiment of the present invention above-explained will be described hereunder.

When the internal combustion engine 10 is in idling operation, the throttling valve 7 closes the intake pipe 30. Therefore the air introduced from the air cleaner 1 is fed into the internal combustion engine 10 through the bypass passage 20. At this time the actuator 4 drives the flow control valve 12 upon receipt of signals from the computer 5 which computes the drive pulse to be applied to the actuator 4 in accordance with various signals such as rotational speed of the engine as explained above. Therefore, by the operation of the flow control valve 12 the amount of the air to be supplied to the engine 10 through the bypass passage 20 is controlled to be optimum at all times.

When the accelerator pedal is depressed to produce power, the throttling valve 7 opens the intake pipe 30 to introduce a large amount of air into the internal combustion engine 10. Therefore, the exhaust gases exhausted from the engine 10 also increases in the exhaust pipe 40 to rotate the turbine 3*b*. The rotation of the turbine 3*b* causes the rotation of the compressor 3*a*, thus introducing the turbochaged or turbocompressed air into the internal combustion engine 10. At this time, the air turbocompressed by the compressor 3*a* increases the air pressure in the surge tank 8 to tend to press the flow control valve 12 from the downstream side. However, in the present invention there is provided a check valve 6 between the flow control valve 12 in the surge tank 8. Therefore, the air of high pressure does not affect the flow control valve 12 at all. This means that there is no pressure difference between the downstream side and the upstream side of the flow control valve 12, i.e. the pressure at both sides is maintained at the same level.

In this embodiment, the check valve 6 is provided between the flow control valve 12 and the surge tank 8 to be separate from each of them. However the check valve 6 can be composed to be unitary with either the flow control valve 12 or the surge tank 8. However, it is important to put the check valve downstream of the flow control valve 12, in other words between the flow control valve 12 and the surge tank 8.

As explained above, according to the present invention, the turbocharged air or the air charged in any other way is prevented from flowing backward toward the air cleaner 1 by the existance of the check valve 6 downstream of the flow control valve 12. Therefore, the effect of the compressor 3*a* is immediately transferred to the internal combustion engine 10 without a time lag, since the turbocharged air does not leak to the side of the atmosphere. Further, it is possible to keep the performance of the actuator 4, since oil mist and soot in or downstream of the surge tank 8 do not enter into the mechanism of the actuator 4. It is also possible to prevent malfunction of the control valve 12, since oil mist and soot do not reach the flow control valve 12 to stick thereon. Moreover, since there is no pressure difference between the upstream side and downstream side of the flow control valve 12, the flow control valve 12 is not disturbed by the pressure in the surge tank 8 throughout the operational ranges of idling and turbocharging, thereby to stabilize the operation of the flow control valve 12 and also to decrease the load which the actuator 4 must overcome.

What we claim is:

1. An idling control device for an internal combustion engine with a turbocharger, comprising:

an air intake pipe having an inlet at an upstream end thereof adapted to accept air which is to be supplied through the air intake pipe to the internal combustion engine and having an outlet at a downstream end thereof adapted to supply such air to said engine;

a turbocharger having a housing incorporated in said air intake pipe between said inlet and said outlet, this housing enclosing at least part of a rotary portion, so that at least some of the air being supplied to the engine is compressed by rotation of said rotary portion as such air passes through said housing, this turbocharger being adapted to contain a liquid lubricant for lubricating said rotary portion in relation to said housing;

a throttle valve incorporated in said air intake pipe between said turbocharger and said outlet, this throttle valve being adapted to vary the effective internal transverse cross-sectional area of said air intake pipe for correspondingly affecting supply of turbocharged air to said engine;

a surge tank incorporated in said air intake pipe between said throttle valve and said outlet;

a bypass air passage means provided in parallel with said air intake pipe between upstream of said turbocharger and downstream of said throttle valve, this bypass air passage means being adapted to supply air to said intake pipe upstream of said outlet, which air is not so compressed as said supply of turbocharged air;

a flow-control valve incorporated in said bypass air passage means, this flow control valve being adapted to vary the effective internal transverse cross-sectional area of said bypass air passage means, without extinguishing such area, for correspondingly affecting supply of bypass air to said engine;

an actuator operatively associated with said flow-control valve, this actuator being adapted to actuate said flow-control valve so as to constrict and dilate said area of said bypass air passage means;

a computer operatively associated with said actuator and arranged to receive signals relating to operating conditions of said engine and to operate said actuator in a predetermined manner in relation to such signals as are received thereby; and a check valve incorporated in said bypass air passage means downstream of said flow-control valve, this check valve being oriented and adapted to prevent turbocharged air and mist of liquid lubricant escaping from sid turbocharger into said air intake pipe downstream of said turbocharger from flowing upstream in said bypass air passage means past said flow-control valve.

2. The idling control device of claim 1, wherein:

said rotary portion of said turbocharger comprises a compressor means and a turbine means;

said bypass air passage means rejoins said air intake pipe upstream of said surge tank; and said actuator includes a portion that is exposed to said bypass air when such bypass air is passing through said flow-control valve, and is subject to malfunction if exposed to an excess of said liquid lubricant; and said check valve is sufficiently effective as to prevent such excess exposure of said portion of said actuator by sufficiently preventing upstream flow of said mist in said bypass air passage means to said flow-control valve.

* * * * *